United States Patent [19]

Ohtomi et al.

[11] 4,422,531

[45] Dec. 27, 1983

[54] TRACTION MACHINE FOR AN ELEVATOR

[75] Inventors: Sadayuki Ohtomi; Yasutaka Hirano; Iturou Tangiku; Tamaiti Kondou, all of Inazawa, Japan

[73] Assignee: Mitsubishi Denki Kabushiki Kaisha, Tokyo, Japan

[21] Appl. No.: 259,609

[22] Filed: May 1, 1981

[30] Foreign Application Priority Data

Jun. 2, 1980 [JP] Japan ..... 55-76504

[51] Int. Cl.[3] ..... B66B 11/04

[52] U.S. Cl. ..... 187/20; 74/413; 254/362

[58] Field of Search ..... 187/20, 21, 22, 23, 187/17; 242/84.1 A, 84.1 R; 254/362, 26 H, 266; 74/412 R, 413, 421 A, 606 R; 188/77.1, 18 A; 403/337, 336, 335, 26; 464/179, 182

[56] References Cited

U.S. PATENT DOCUMENTS

| | | | |
|---|---|---|---|
| 2,244,221 | 6/1941 | Schroeder | 254/362 |
| 2,746,583 | 5/1956 | Blevins | 254/362 |
| 3,285,573 | 11/1966 | Hanawa et al. | 254/362 |
| 3,641,832 | 2/1972 | Shigeta et al. | 187/20 |
| 4,006,867 | 2/1977 | Miyamae | 242/84.1 A |

*Primary Examiner*—Joseph J. Rolla
*Assistant Examiner*—Kenneth Noland
*Attorney, Agent, or Firm*—Wenderoth, Lind & Ponack

[57] ABSTRACT

In a traction machine for an elevator having a reduction gear enclosed within a main housing and having an input shaft and an output shaft together with parallel shaft gears, a traction sheave connected to the output shaft, an electric motor connected to the input shaft, a brake gear, and a flywheel, at least one of the electric motor, the brake gear and the flywheel is arranged on the same side as the traction sheave, whereby a peripheral portion of one of the side surfaces of the at least one of the above elements confronts a peripheral portion of one of the side surfaces of the traction sheave.

6 Claims, 13 Drawing Figures

TRACTION MACHINE FOR AN ELEVATOR

BACKGROUND OF THE INVENTION

The present invention relates to an elevator and more particularly to a traction machine for an elevator.

Firstly, reference is made to FIGS. 1 and 2 of the attached drawings wherein is shown a conventional traction machine for an elevator. In FIGS. 1 and 2, reference numeral 1 shows a hoist way for an elevator, 2 a machine room provided at the top end of the hoist way 1, and 3 a reduction gear installed on the floor of the machine room 2 and principally comprising an input shaft 3*a* and an output shaft 3*b* arranged in parallel with each other, each carrying spur gears. 4 is a traction sheave rotatively connected to the output shaft 3*b* of the reduction gear 3, 5 an electric motor arranged oppositely to the traction sheave 4 relative to the reduction gear 3, the shaft of the motor 5 being connected to the input shaft 3*a* of the reduction gear 3 and fixedly secured to reduction gear 3 by a bracket 6. 7 is a brake gear mounted to the motor 5, on the end thereof opposite to the reduction gear 3, 8 main hoisting wire ropes reeved on the traction sheave 4 and suspending a cage 9 and a counter weight 10 at their ends, respectively, and 11 a deflector sheave. Thus, it will be appreciated that since the conventional traction machine is formed such that the reduction gear 3, the traction sheave 4, the electric motor 5, etc. are arranged in series, a large space is required for installation of the traction machine, and in the case of a small elevator, etc. when the machine room 2 is narrow, the installation of the traction machine is made impossible, and the space necessary for carrying out maintenance operations for the traction machine is small, making maintenance difficult, etc. Thus, the conventional traction machine clearly reveals various disadvantages.

On the other hand, since it is usual that the traction sheave 4 is disposed substantially on the center line of the plane of the hoist way 1 as shown in FIGS. 1 and 2, it is necessary for the machine room 2 to be erected at the top end of the hoist way 1 with a portion being protruded outwards from the position corresponding to the top end portion of the hoist way 1, so that the efficiency of utilization of the building is low, revealing another defect of the conventional traction machine.

SUMMARY OF THE INVENTION

It is one object of the present invention to provide a traction machine for an elevator which can eliminate all of the defects as above described inherent in the conventional machine.

It is another object of the present invention to provide a traction machine for an elevator which can be easily installed even within a relatively small machine room.

It is a further object of the present invention to provide a traction machine for an elevator which is easily transported to a desired destination.

In accordance with the present invention a traction machine for an elevator is provided which is characterized in that in a reduction gear enclosed within a main casing in which are principally contained an input shaft and an output shaft arranged in parallel with each other, each provided with parallel gears, a traction sheave connected to the output shaft, an electric motor arranged on the input shaft, a brake gear, and a flywheel, at least one among the electric motor, the brake gear and the flywheel is arranged on the same side as the traction sheave relative to the reduction gear such that a peripheral portion of one of its side surfaces confronts a peripheral portion of one of the side surfaces of the traction sheave.

BRIEF DESCRIPTION OF THE DRAWINGS

These and other objects of the present invention will become more readily apparent upon reading the following specification, with reference to the accompanying drawings, in which.

DETAILED DESCRIPTION OF THE PREFERRED EMBODIMENTS

Figure 1:
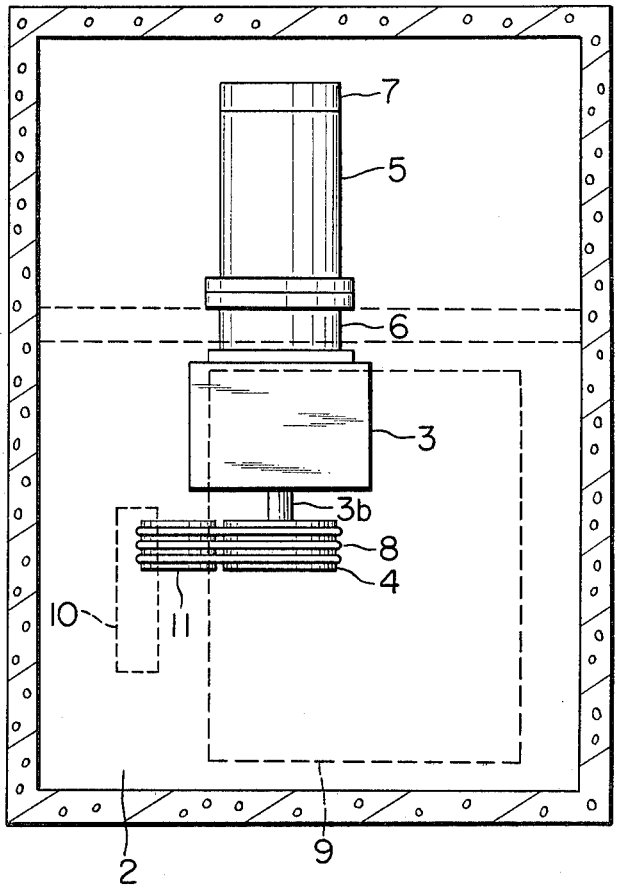
FIG. 1 (PRIOR ART)
FIG. 1 is a plan view schematically showing an example of a conventional traction machine for an elevator.
Figure 2:
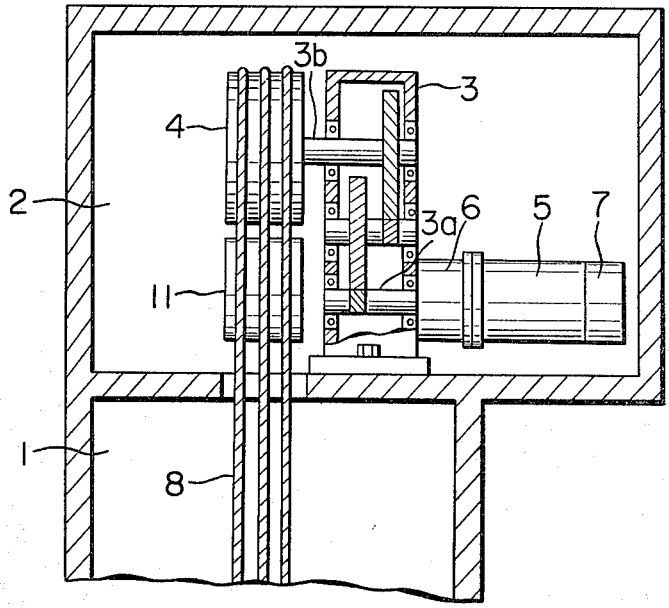
FIG. 2 (PRIOR ART)
FIG. 2 is a front elevational view of FIG. 1 partially in section.
Figure 3:
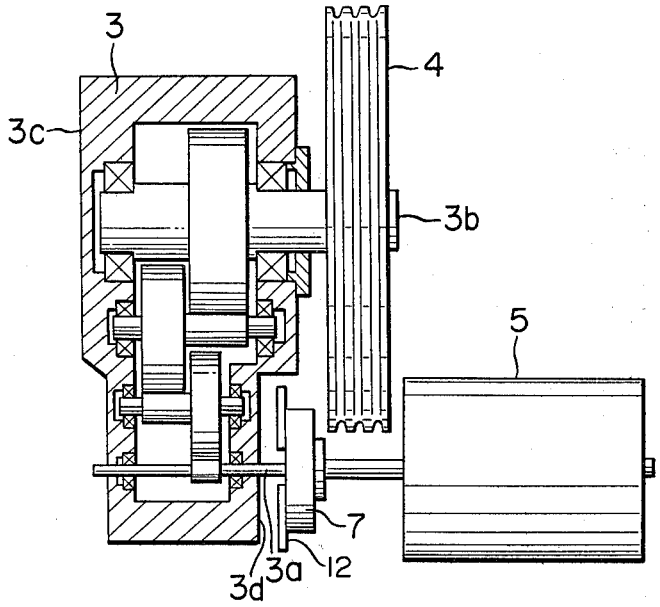
FIG. 3 is a partial cross-sectional view of a first embodiment of a traction machine for an elevator according to the present invention.
Figure 4:
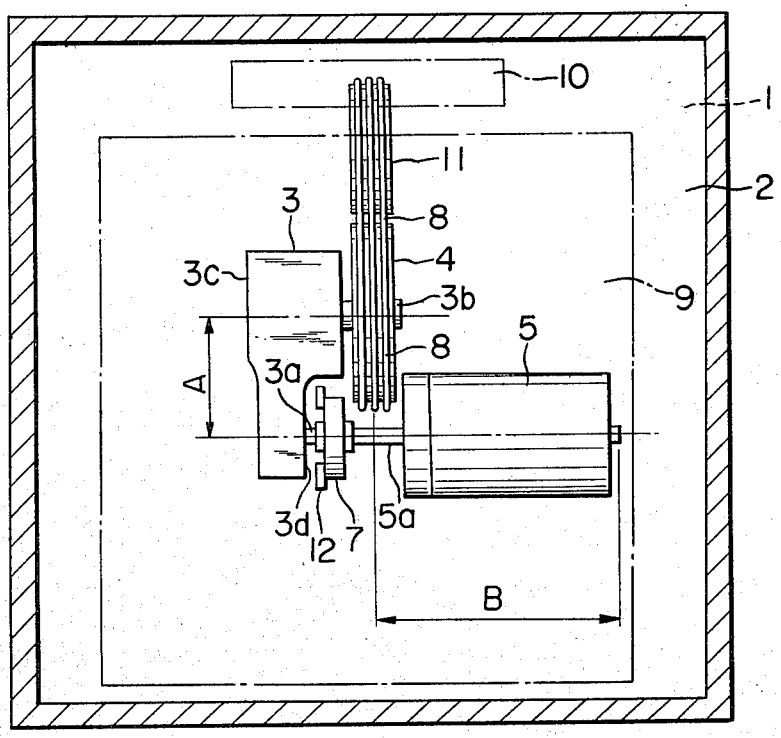
FIG. 4 is a plan view of the present invention shown in FIG. 3 showing the manner of its installation within a machine room.

Referring now to FIGS. 3 and 4 wherein is shown an embodiment of the present invention, the reference numeral 3 shows a reduction gear mechanism comprising parallel shafts each carrying helical gears, etc. and having an input 3*a* and an output shaft 3*b* arranged on a horizontal plane, and 3*c* is a main housing having a recessed portion 3*d* at the side where the input shaft 3*a* passes therethrough. 4 is a traction sheave disposed near the housing 3*c* at the side where the recessed portion 3*d* is provided and rotatively connected to the output shaft 3*b* of the reduction gear 3, and 7 is a brake drum arranged within the recessed portion 3*d* of the main housing 3*c* of the reduction gear 3 with a clearance being left there-between and mounted on the input shaft 3*a* to form a part of a brake gear to be mounted thereon, whereby one of the end surfaces of brake drum 7 is disposed so as to confront a portion of the periphery of one of the side surfaces of the traction sheave 4. 5 is an electric motor having its shaft 5*a* connected to the input shaft 3*a* of the reduction gear 3 through the brake drum 7, whereby one of the end surfaces of the motor 5 is disposed so as to confront a portion of the periphery of the other side surface of the traction sheave 4 remote from the reduction gear 3. 12 is a flywheel fixedly secured to the brake drum 7 on its other side surface confronting the recessed portion 3*d* of the reduction gear 3.

That is, it will be appreciated that in this first embodiment of the present invention, the peripheral portions of the side surfaces of the traction sheave 4 are disposed, in the plan view, between one of the side surfaces of the brake drum 7 and one of the end surfaces of the motor 5, or in other words both side surfaces of the traction sheave 4 are arranged so as to confront the brake drum 7 and the motor 5, and the housing 3*c* of the reduction gear 3 is provided with the recessed portion 3*d* to receive the brake drum 7 therein. Therefore, as shown in FIG. 4, the dimensions A and B of the traction machine indicated therein are decreased so that it can be installed within a narrow machine room 2. Further, since the outer configuration of the traction machine is made small, its transport action and packaging are also simplifiifed. Thus, since in the first embodiment the housing of the reduction gear is provided with the recessed portion to arrange therein the brake drum, and the peripheral portions of the side surfaces of the traction sheave 4 are arranged so as to confront one of the end surfaces of the motor and one of the side surfaces of the brake drum, a traction machine for an elevator is realized which requires only a small space for installation, allowing easy installation within a small machine room, and which can be easily transported.

Although it has been described in reference to the first embodiment that one of the side surfaces of the brake drum 7 and one of the end surfaces of the electric motor 5 are constructed to confront the peripheral portions of the side surfaces of the traction sheave 4, even when only one of the side surface of the brake drum 7 and the end surface of the motor 5 is made to confront the traction sheave 4, it may be possible to reduce the required space for and the outer configuration of the traction machine.

Figure 5:
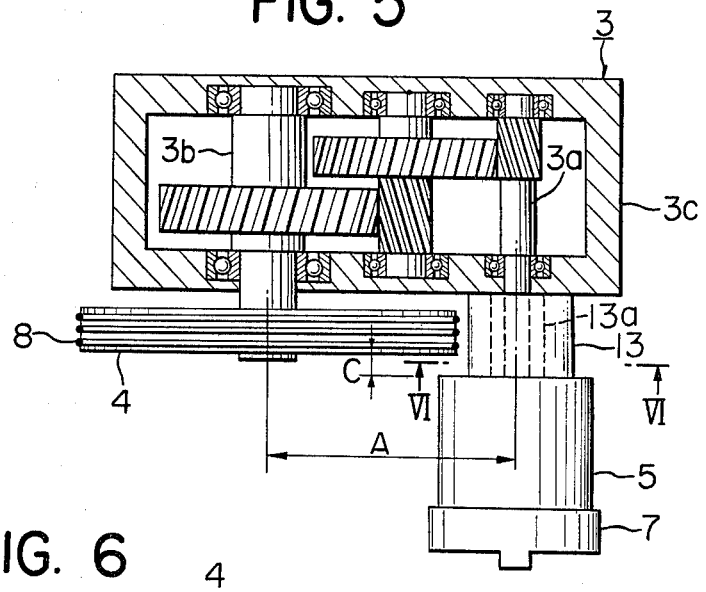
FIG. 5 is a view similar to FIG. 3 but showing a second embodiment of the present invention.
Figure 6:
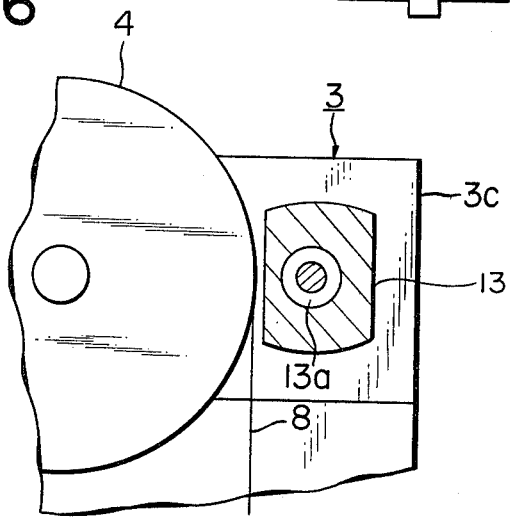
FIG. 6 is a sectional view of FIG. 5 taken along the line VI—VI of FIG. 5.

FIGS. 5 and 6 show the second embodiment of the present invention wherein 3 is a reduction gear having parallel shafts each carrying helical gears and comprising an input shaft 3*a* and an output shaft 3*b* arranged on a horizontal plane, all being enclosed within a main housing 3*c*. 13 is a mounting frame one of the end surfaces of which is fixedly secured to the main housing 3*c*, and the peripheral surface of which confronts the peripheral surface of a traction sheave 4, whereby the distance A between the centers of the input shaft 3*a* and the output shaft 3*b* of the reduction gear 3 is made smaller than the outer diameter of an electric motor 5 which is secured at one of its end surfaces to the other end surface of the mounting frame 13 such that the end surface of the motor 5 confronts a peripheral portion of one of the side surfaces of the traction sheave 4. The shaft of the motor 5 passes through the bore 13*a* of the mounting frame 13 to be connected to the input shaft 3*a*. Thus, in the second embodiment, as shown in FIG. 5, the peripheral portion of one of the side surfaces of the traction sheave 4 is arranged so as to confront one of the end surfaces of the motor 5 by means of the mounting frame 13. Thanks to this measure, the distance A between the centers of the input and output shafts 3*a*, 3*b* can be made small, contributing to make the outer configuration and the space required for installment of the traction machine small. Further, by appropriately selecting the gap c between the peripheral portions of one of the side surfaces of the traction sheave 4 and one of the end surfaces of the motor 5, the traction sheave 4 can be replaced without the need of dismounting the motor 5.

Figure 7:
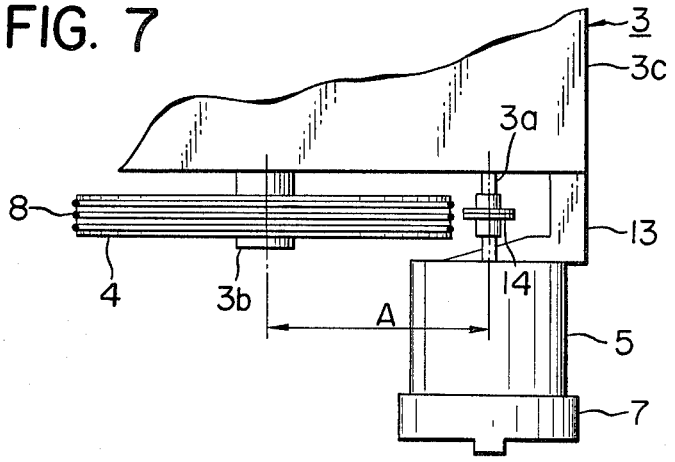
FIG. 7 is a view similar to FIG. 5 but showing a third embodiment of the present invention.
Figure 8:
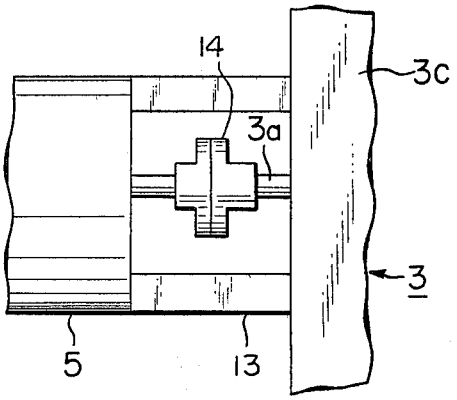
FIG. 8 is a view of FIG. 7 as viewed from the right thereof and on a somewhat larger scale.

FIGS. 7 and 8 show a third embodiment of the present invention. In this third embodiment the mounting frame 13 in the second embodiment as shown in FIGS. 5 and 6 is secured at one of its end surfaces to the main housing 3*c* at a position remote from the traction sheave 4, and the mounting frame 13 is secured at the other end to an electric motor 5 at one of its end surfaces such that this end surface confronts a peripheral portion of one of the side surfaces of the traction sheave 4, whereby the shaft of the motor 5 is connected to the input shaft 3*a* through a shaft coupling 14. Thus, also in this third embodiment, since the peripheral portions of one of the side surfaces of the traction sheave 4 and one of the end surfaces of the motor 5 are arranged so as to confront each other, it is apparent, although the detailed explanation is omitted, that this embodiment reveals the same advantages as those obtainable from the second embodiment above described.

Figure 9:
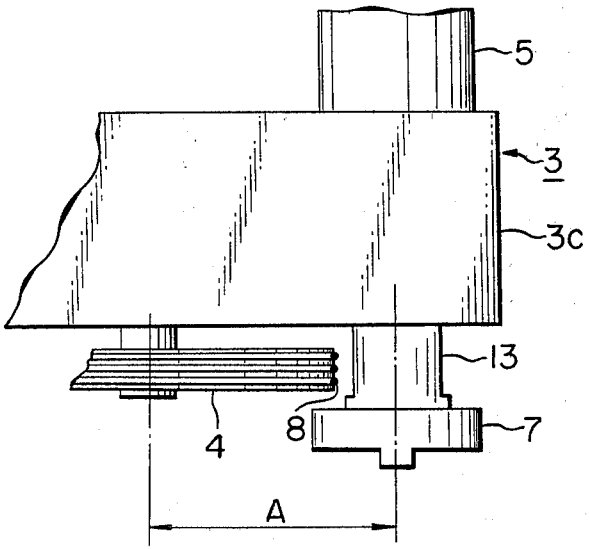
FIG. 9 is a view similar to FIG. 7 but showing a fourth embodiment of the present invention.

FIG. 9 shows a fourth embodiment of the present invention wherein the reference numeral 5 is an electric motor secured to a main housing 3*c* of a reduction gear 3 on the side opposite to a traction sheave 4, the shaft of motor 5 being connected to the end of an input shaft not shown. 7 is a brake drum mounted to the end of an input shaft extending through a mounting frame 13 similar to that in the second embodiment shown in FIGS. 5 and 6 such that a peripheral portion of one of the end surfaces of the drum 7 confronts a peripheral portion of one of the side surfaces of the traction sheave 4. Thus, also in this fourth embodiment, since the center distance A between the traction sheave 4 and the brake drum 7 can be made small, it is apparent, although no detailed explanation is given herein, that also the fourth embodiment can exhibit advantages corresponding to those of the second embodiment described above.

From the foregoing it will be appreciated that since in the second, third and fourth embodiments at least one of an electric motor or a brake drum is mounted to a reduction gear on the same side thereof at which is disposed a traction sheave through a mounting frame such that its side surface confronts a peripheral portion of one of the side surfaces of the traction sheave, the central distance between an input shaft and an output shaft of the reduction gear can be made small, enabling the outer configuration of a traction machine for an elevator to be made small, and making the space required for its installment small, reducing the cost of the elevator equipment.

Figure 10:
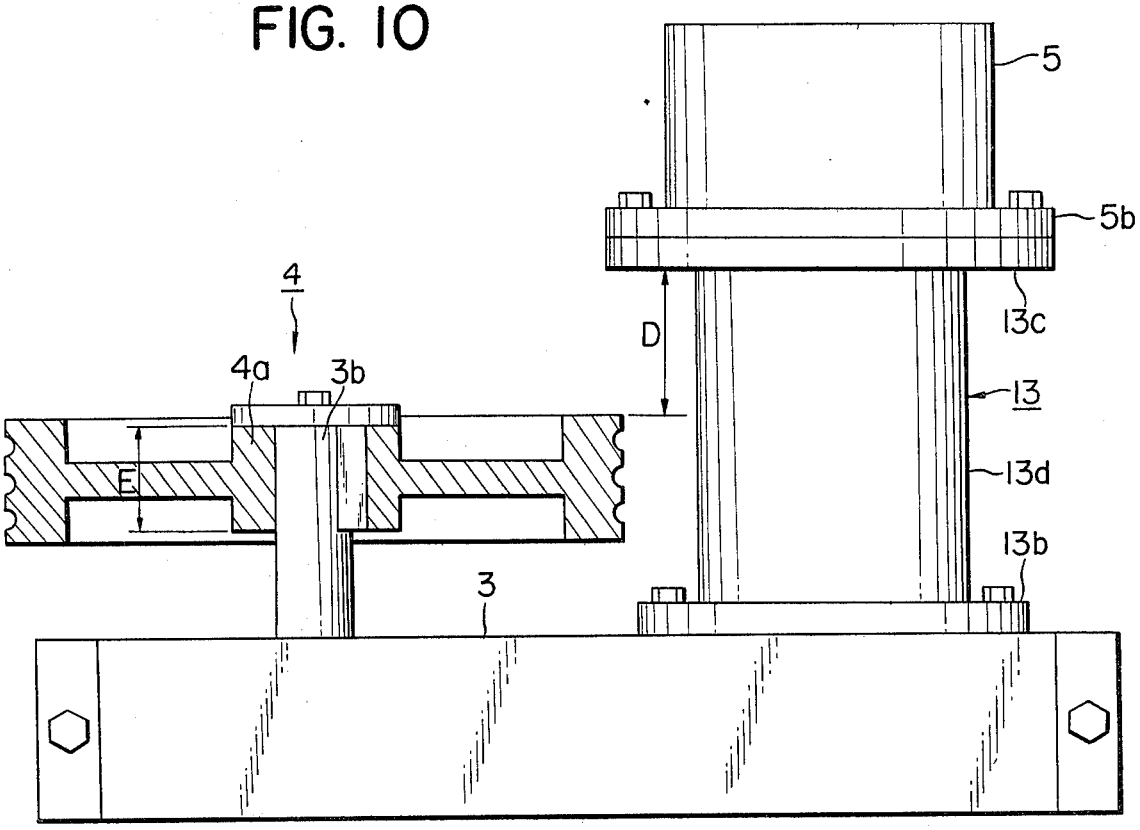
FIG. 10 is a partial sectional plan view of a fifth embodiment of a traction machine for an elevator in accordance with the present invention.

FIG. 10 shows a fifth embodiment of the present invention in which the reference numeral 13 is a bracket which has a mounting portion 13*b* at one of its ends to be secured to a reduction gear 3 by bolts, a mounting portion 13*c* at its other end to mount an electric motor 5 through its flange 5*b* by bolts, and an intermediate portion 13*d* having a diameter smaller than the outer diameter of the motor 5, whereby the bracket 13 receives within it an input shaft of the reduction gear 3 and the shaft of the motor 5 connected thereto. 4 is a traction sheave keyed to the end of an output shaft 3*b* of the reduction gear 3, its peripheral surface confronting the intermediate portion 13*d* of the bracket 13, and one of the side surfaces of the sheave 4 confronting the motor mounting portion 13*c* of the bracket 13 separated therefrom by a distance D, the boss 4*a* of the sheave 4 having a length E.

Thus, in this fifth embodiment the traction sheave 4 and the electric motor 5 are disposed at the same side of the reduction gear 3 and are staggered with respect to each other. Accordingly, the dimension of the traction machine in the plan view is made small, reducing the space required for its installation. Further, by shaping and arranging the traction sheave 4 so as to satisfy the condition described below, the sheave 4 can be dismounted from the output shaft 3*b* of the reduction gear 3 without the need of dismounting the motor 5 from the bracket 13, making the replacement of the sheave 4 when damaged, etc. easy. That is, the dimension D is made larger than the dimension E. By doing so, upon releasing the fastening between the output shaft 3*b* and the traction sheave 4 and shifting the sheave in the longitudinal direction of the output shaft 3*b*, the engagement of the traction sheave 4 with the end of the output shaft 3*b* is released prior to the abutment of one of the side surfaces of the traction sheave 4 against the motor mounting portion 13*c* of the bracket 13.

Figure 11:
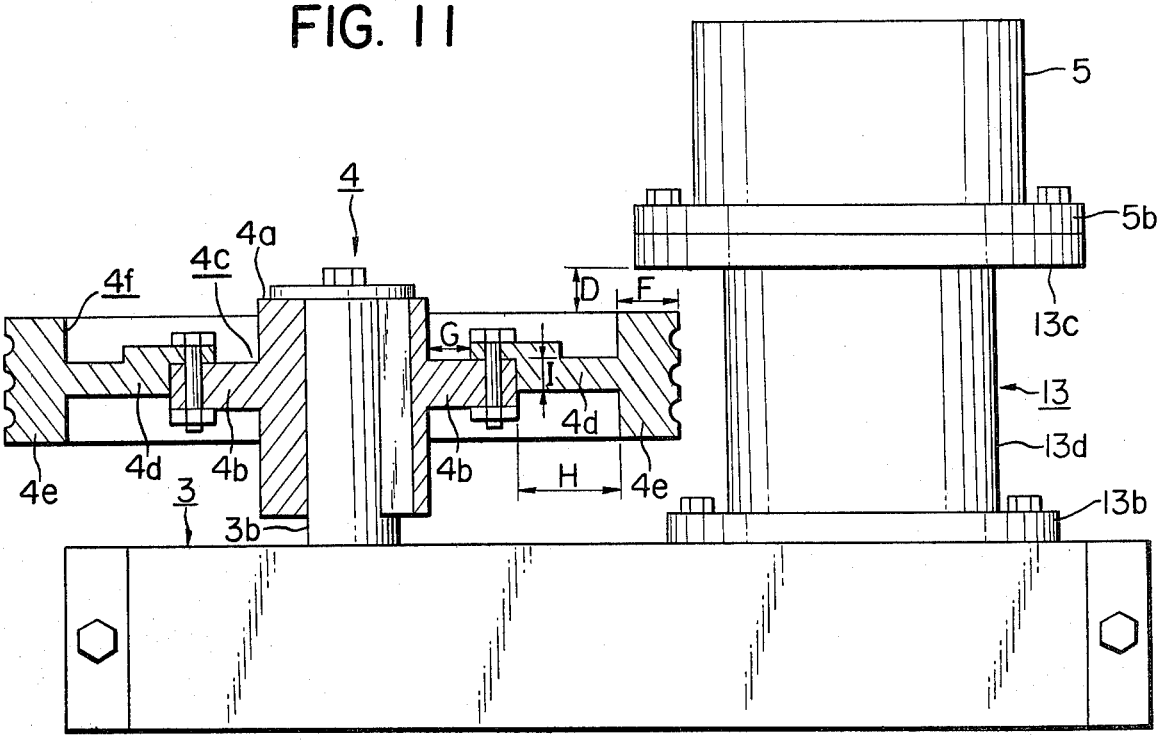
FIG. 11 is a view similar to FIG. 10 but showing a sixth embodiment of the present invention.

FIG. 11 shows a sixth embodiment of the present invention wherein the traction sheave 4 shown in FIG. 5 is modified so as to comprise a fastening portion 4*c* having a boss portion 4*a* to be mounted to the end of the output shaft 3*b* of the reduction gear 3 and a flange portion 4*b* elongating radially from the boss portion 4*a*, and a rim portion 4*f* having an annular engaging portion 4*d* to partially overlap and partially embrace the periphery of the flange portion 4*b* of the fastening portion 4*c* and a ring portion 4*e* integrally formed with the engaging portion 4*d* and having an outer periphery around which hoist wire ropes are reeved. The various reference numerals entered in the drawing for dimensions represent the following:

I=The embracing depth between the upper end surface of flange portion 4*b* and the bottom of the engaging portion 4*d*;

D=The distance between one of the side surfaces of the annular portion 4*e* and one of the end surfaces of the motor mounting portion 13*c* of the bracket 13;

G=The distance between the outer periphery of the cylindrical portion of the boss portion 4*a* and the inner periphery of the engaging portion 4*d*; and H=The distance between the outer periphery of the flange portion 4*b* and the inner periphery of the ring portion 4*e*.

That is, also in this embodiment, since the traction sheave 4 and the motor 5 are disposed similarly to the case of the fifth embodiment, it is apparent, although no detailed explanation is given here, that the present embodiment operates similarly to the fifth embodiment. Further, by selecting the dimensions so as to be $$D>I,\ G>F \text{ and } H>F,$$

the rim portion 4*f* of the traction sheave 4 can be dismounted from the fastening portion 4*c* of the traction sheave 4 and the fastening portion 4*c* can be dismounted from the output shaft 3*b* of the reduction gear 3 without the need of dismounting the motor 5 from the bracket 13. That is, upon releasing the fastening between the rim portion 4*f* and the fastening portion 4*c* of the traction sheave 4 and shifting the rim portion 4*f* in the longitudinal direction of the outer shaft 3*b*, the engagement of the flange portion 4*b* with the engaging portion 4*d* is released prior to the abutment of one of the side surfaces of the ring portion 4*f* against the confronting end surface of the motor mounting portion 13*c* of the bracket 13. In this state, upon shifting the rim portion 4*f* in a direction orthogonal to the axis of the output shaft 3*b* away from the bracket 13, the engagement of one of the side surfaces of the rim portion 4*f* with the confronting side surface of the motor mounting portion 13*c* of the bracket 13 is released prior to the abutment of the inner periphery of the rim portion 4*f* against the outer periphery of the flange portion 4*b*, the inner periphery of the ring portion 4*e* abutting against the outer periphery of the flange portion 4*b*. In this state, the rim portion 4*f* can be dismounted lengthwise from the output shaft 3*b*. Thus, this embodiment reveals an operation similar to that of the fifth embodiment.

Also it is conceivable that in the sixth embodiment shown in FIG. 11 the fastening portion 4*c* of the traction sheave 4 may be integrally constructed with the output shaft 3*b* of the reduction gear 3.

Thus, in the fifth and sixth embodiments, the traction sheave and the motor are disposed on the same side of the reduction gear comprising parallel axis gears, and the motor is mounted to the reduction gear through the bracket having a smaller diameter than the outer diameter of the motor, the peripheral surface of the traction sheave confronting the intermediate portion of the bracket, and a peripheral portion of one of the side surfaces of the traction sheave is arranged so as to confront the connecting portion of the motor with the bracket, making it possible to replace the traction sheave without necessitating dismounting the motor from the bracket. By adopting such a constitution, the traction machine can be easily installed within a small machine room, and the maintenance operation made easy, so that a traction machine for an elevator which has low installation and maintenance costs can be realized.

Figure 12:
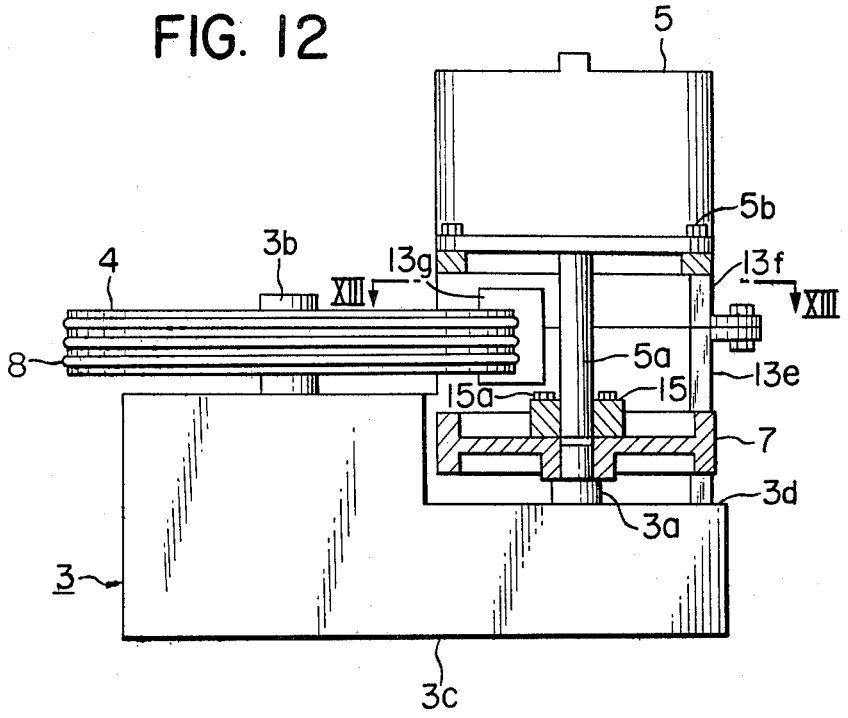
FIG. 12 is a partial cross-sectional view of a seventh embodiment of the present invention.
Figure 13:
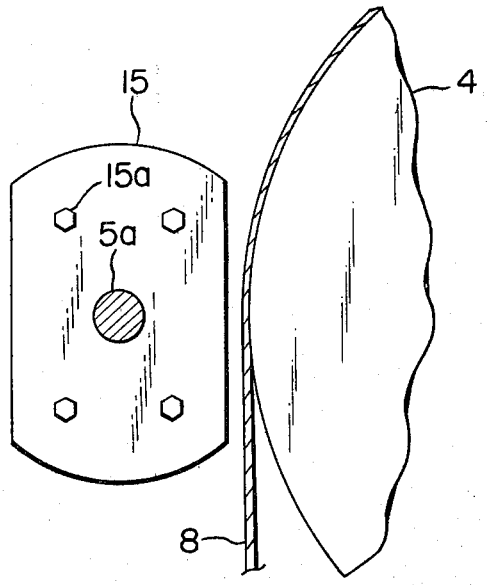
FIG. 13 is an enlarged sectional view of FIG. 12 taken along the line XIII—XIII of FIG. 12.

FIGS. 12 and 13 show a seventh embodiment of the present invention wherein the reference numeral 3 is a reduction gear comprising parallel axis gears such as spur gears, and having an input shaft 3*a* and an output shaft 3*b* disposed at the same side on a horizontal plane, the reduction gear 3 being provided with a main housing 3*c* having a recessed portion 3*d* at the protruding portion therefrom of the input shaft 3*a*. 4 is a traction sheave arranged at the side of the recessed portion 3*d* of the main housing 3*c* of the reduction gear 3 and drivingly connected to the output shaft 3*b* of the reduction gear 3, 7 being a braking drum connected to the input shaft 3*a* of the reduction gear 3 and constituting a brake gear, the braking drum 7 being adapted to serve simultaneously as a shaft coupling and having a flange-like shape, whereby a peripheral portion of one of the side surfaces of the brake drum 7 confronts a peripheral portion of one of the side surfaces of the traction sheave 4. 5 is an electric motor with its shaft 5*a* confronting the input shaft 3*a* of the reduction gear 3, the motor 5 being connected at one of its end surfaces by bolts 5*b* to a mounting frame 13*e*, 13*f* which comprises two members and is secured to the reduction gear 3 at one of its side surfaces so that a peripheral portion of one of the end surfaces of the motor 5 confronts at the side of the shaft 5*a* a peripheral portion of the other side surface of the traction sheave 4. 13*g* is an opening shaped in the mounting frame 13*e*, 13*f* adapted to be passed through by hoisting wire ropes not shown, and 15 is a plate-like jointer having a substantially rectangular configuration, mounted to the end of the shaft 5*a* of the motor 5 and secured to the brake drum 7 by bolts 15*a*, and connects the shaft 5*a* of the motor 5 with the input shaft 3*a* of the reduction gear 3. The dimension of the jointer 15 in the widthwise direction from the center of the shaft 5*a* is defined so as to be less than the distance from the center of the shaft 5*a* to the outer peripheral surface of the traction sheave 4. Thus, also in this seventh embodiment, as in the case of the first embodiment, the space required for installation is small, making installation within a small machine room easy, and making the outer configuration small. Further, since the jointer 15 is shaped so as to have a rectangular plate-like configuration, in a position where its longer side faces the outer peripheral surface of the traction sheave 4, when the bolts 15*a* are dismounted from the jointer 15 and the bolts 5*b* are dismounted from the motor 5, the motor 5 can be dismounted from the reduction gear 3 with the traction sheave 4 intact. Conversely the motor 5 can be mounted to the reduction gear 3 in a similar manner.

Therefore, a traction machine for an elevator can be provided which makes the mounting or dismounting of an electric motor at the time of assembly or disassembly easy. That is, in this seventh embodiment, in a traction machine in which a peripheral portion of one of the side surfaces of the traction sheave and a portion of one of the end surfaces of the electric motor are arranged in a partially overlapping fashion, the dimension from one of the sides of the jointer connecting the shaft of the motor with the input shaft of the reduction gear to the center of the shaft of the motor is selected to be less than the distance between the center of the shaft of the motor and the outer peripheral surface of the traction sheave. By adopting such a specific dimensional relationship, a traction machine for an elevator can be realized in which the motor can be easily mounted or dismounted with the traction sheave being mounted to the reduction gear, so the assembly or disassembly operation, particularly at the time of maintenance operations after the installation of the elevator, is simplified, sparing operational costs.

It is to be understood that although certain forms of the present invention have been illustrated and described, the invention is not to be limited thereto except so far as such limitations are included in the following claims.

What is claimed is:

1. A traction machine for an elevator, said traction machine comprising:

a reduction gear mechanism including a main housing having therein parallel axis gears, an input shaft and an output shaft extending parallel to said input shaft;

an electric motor and a brake gear connected to said input shaft;

a traction sheave connected to said output shaft;

a bracket secured at one end surface thereof to said main housing on the side thereof on which is positioned said traction sheave, said bracket having another end surface, an intermediate portion between said end surfaces and a securing portion extending radially outwardly from said intermediate portion at said another end surface;

said electric motor being secured to said securing portion;

a peripheral surface of said traction sheave confronting said intermediate portion of said bracket; and said peripheral portion of said one side surface of said traction sheave confronting and facing toward said securing portion of said bracket so that, upon release of connection of said traction sheave with said output shaft and shift of said traction sheave in the longitudinal direction of said output shaft till said one side surface of said traction sheave abuts said securing portion of said bracket, the engagement of said traction sheave with said output shaft is released and said traction sheave is shiftable in such disengaged condition in a direction orthogonal to the axis of said output shaft until said side surface of said traction sheave reaches a position not confronting said securing portion of said bracket.

2. A machine as claimed in claim 1, wherein said traction sheave comprises a boss adapted to be mounted on said output shaft, and a peripheral portion adapted to be secured to said boss and provided with an outer peripheral surface to be reeved thereover by main hoisting wire ropes.

3. A traction machine for an elevator, said traction machine comprising:

a reduction gear mechanism including a main housing having therein parallel axis gears, an input shaft and an output shaft extending parallel to said input shaft;

a traction sheave connected to said output shaft;

a brake drum secured as a shaft coupling to said input shaft at the side of said main housing on which said traction sheave is disposed;

an electric motor having a shaft, said electric motor being disposed such that a peripheral portion of the shaft side end surface of said electric motor confronts a peripheral portion of one side surface of said traction sheave; and said shaft of said electric motor being connected to said input shaft through a plate-like connector means secured to a projecting end of said shaft of said electric motor and to said brake drum, the distance from a longer side of said plate-like connector means, elongated in a direction orthogonal to the longitudinal direction of said shaft of said electric motor, to the center of said shaft of said electric motor being selected to be less than the distance from the peripheral surface of said traction sheave to said center of said shaft of said electric motor.

4. A machine as claimed in claim 3, wherein a peripheral portion of one side surface of said brake drum confronts a peripheral portion one side surface of said traction sheave.

5. A machine as claimed in claim 3, wherein said plate-like connector has substantially a rectangular configuration.

6. A machine as claimed in claim 3, wherein said main housing has a recessed portion at the side thereof on which said traction sheave is positioned, and said brake drum is arranged within said recessed portion.

* * * * *